US011229257B1

(12) United States Patent
Brunetta

(10) Patent No.: US 11,229,257 B1
(45) Date of Patent: Jan. 25, 2022

(54) METHODS FOR AND FOOTWEAR ASSEMBLIES WITH RELEASABLE ATTACHMENT OF SOLES

(71) Applicant: Winnies Socks Company LLC, Wolfboro, NH (US)

(72) Inventor: Kara A. Brunetta, Sterling, MA (US)

(73) Assignee: Winnies Socks Company LLC, Wolfeboro, NH (US)

( * ) Notice: Subject to any disclaimer, the term of this patent is extended or adjusted under 35 U.S.C. 154(b) by 59 days.

(21) Appl. No.: 16/437,117

(22) Filed: Jun. 11, 2019

Related U.S. Application Data

(60) Provisional application No. 62/684,479, filed on Jun. 13, 2018.

(51) Int. Cl.
*A43B 1/00* (2006.01)
*A43B 3/18* (2006.01)
(Continued)

(52) U.S. Cl.
CPC ..... *A43B 3/108* (2013.01); *A41B 11/10* (2013.01); *A43B 1/0054* (2013.01); *A43B 3/18* (2013.01); *A43B 11/00* (2013.01); *A43B 13/14* (2013.01)

(58) Field of Classification Search
CPC ..... A43B 1/0054; A43B 3/16; A43B 3/18; A43B 11/00; A43B 11/02; A43B 17/18
(Continued)

(56) References Cited

U.S. PATENT DOCUMENTS 2,418,342 A * 4/1947 Freedman ..... A43B 11/02 36/1
2,717,437 A 9/1955 De Mestral
(Continued)

FOREIGN PATENT DOCUMENTS

JP 2004337529 12/2004

OTHER PUBLICATIONS

21K Footwear LTD T/A Mahabis, "reinventing the slipper, rethinking comfort & style," website page, retrieved Apr. 5, 2020, from the https://maharis.com website of Mahabis Limited, St. Asaph, Denbighshire, Wales, UK, the website archived on Jun. 18, 2016, by the Wayback Machine of Internet Archive, San Francisco, CA (7 pp.) <URL: https://web.archive.org/web/20160618153102/http://www.mahabis.com/pages/classic-slipper >.
(Continued)

*Primary Examiner* — Sharon M Prange
(74) *Attorney, Agent, or Firm* — Maura K. Moran; Cambridge Technology Law LLC

(57) ABSTRACT

A footwear assembly has releasably attachable sock and oversock arranged to cover the user's toes and heels. A user puts the sock on a first foot, puts the sock-covered toes into a water-resistant oversock's toe cap, stretches the oversock sole along its length by pressing a second foot down on a protrusion extending outward from the heel of the oversock sole, and releases the stretched sole to bring the oversock heel toward the sock-covered heel. An attachment fastener has a single sock attachment site, located on the rear of the sock at a heel rear portion, and a single oversock attachment site, located on a rear section of the oversock. The sock releasably attaches to the oversock at only the single sock attachment site; and the oversock releasably attaches to the sock at only the single oversock attachment site.

11 Claims, 7 Drawing Sheets

(51) Int. Cl.

| | |
|---|---|
| ***A43B 11/00*** | (2006.01) |
| ***A43B 3/10*** | (2006.01) |
| ***A41B 11/10*** | (2006.01) |
| ***A43B 13/14*** | (2006.01) |

(58) Field of Classification Search
USPC ..... 36/101
See application file for complete search history.

(56) References Cited

U.S. PATENT DOCUMENTS 3,283,423 A * 11/1966 Schovee ..... A43B 3/16 36/7.3
3,538,628 A 11/1970 Einstein
4,926,568 A 5/1990 Coffman
5,056,240 A * 10/1991 Sherrill ..... A43B 3/16 36/7.3
5,083,385 A 1/1992 Halford
5,165,182 A * 11/1992 Michael ..... A43B 3/16 36/1.5
5,499,459 A * 3/1996 Tomaro ..... A43B 1/0045 36/10
5,727,334 A 3/1998 Cougar
5,855,079 A * 1/1999 Herbert ..... A43B 7/12 36/88
6,345,454 B1 2/2002 Cotton
6,349,486 B1 2/2002 Lin
6,640,465 B1 11/2003 Burgess
6,880,268 B2 4/2005 Chen
6,915,596 B2 7/2005 Grove
7,082,704 B2 * 8/2006 Throneburg ..... A43B 7/16 36/25 R
7,188,438 B1 * 3/2007 Bowen ..... A43B 3/166 36/138
7,434,336 B2 * 10/2008 Kosted ..... A43B 1/0081 36/10
7,451,557 B2 11/2008 McDonald
7,520,069 B2 4/2009 Workman
8,028,441 B2 10/2011 Stefani
8,104,196 B2 1/2012 Spinelli
8,230,621 B2 7/2012 Shmurak
8,567,098 B2 10/2013 Hsu
8,769,845 B2 * 7/2014 Lin ..... A43B 23/027 36/138
9,532,624 B2 * 1/2017 Lap ..... B29D 35/04
10,561,201 B1 * 2/2020 Woodbury ..... A43B 1/0081
2006/0112591 A1 6/2006 Lombardo
2008/0005927 A1 1/2008 Hung
2011/0167538 A1 7/2011 Germann
2012/0227281 A1 * 9/2012 Young ..... A43B 3/24 36/10
2014/0250569 A1 * 9/2014 Riley ..... A41B 11/002 2/239
2014/0345162 A1 11/2014 Mitchell
2015/0245688 A1 * 9/2015 Young ..... A43B 3/10 36/10
2015/0305442 A1 * 10/2015 Ravindran ..... A43B 23/28 36/138
2016/0029739 A1 2/2016 Dias
2016/0242504 A1 8/2016 Cowley
2017/0027272 A1 * 2/2017 Yeglinski, II ..... A43B 1/0081
2017/0231324 A1 * 8/2017 Arquilla ..... A43B 1/009 36/10
2019/0116916 A1 * 4/2019 Burch ..... A43B 1/0072

OTHER PUBLICATIONS

Major, An Introduction to Sock Knitting, p/hop for Médecins Sans Frontières/Doctors Without Borders (MSF), 2010, downloaded Feb. 10, 2021, from www.p-hop.co.uk/wp-content/uploads/2010/10/phopSockTips.pdf, 3 pp., Médecins Sans Frontières/Doctors Without Borders (MSF), London, England, GB.
White, Sock Knitting Terms and Parts, updated Aug. 4, 2019, downloaded Feb. 9, 2021, from https://www.thesprucecrafts.com/sock-knitting-terms-3876011, 8 pp., The Spruce Crafts, New York, NY.
Hook and Loop Performance Measures, downloaded Mar. 19, 2021, from https://www.hookandloop.com/performance-measures/, 3 pp., hookandloop.com, Jacksonville, FL.
Velcro Brand Woven Fasteners, uploaded to https://www.velcro.com/business/products/textile-hook-and-loop/ as a .pdf link https://s23775.pcdn.co/wp-content/uploads/sites/2/2017/02/VELCRO%C2%AE-Brand-Woven-Fasteners.pdf, downloaded Mar. 19, 2021, 2 pp., Velcro Companies, Manchester, NH.
Stahl, What are the properties of velcro?, uploaded 2017, downloaded Mar. 19, 2021, from https://www.quora.com/What-are-the-properties-of-velcro/answer/Alex-Stahl-2, quora.com, Mountain View, CA.

* cited by examiner

METHODS FOR AND FOOTWEAR ASSEMBLIES WITH RELEASABLE ATTACHMENT OF SOLES

CROSS-REFERENCE TO RELATED APPLICATION none

FIELD

The present invention relates to the field of footwear and particularly to releasable attachment of soles to footwear.

BACKGROUND

This invention relates to methods and systems which facilitate releasable attachment of soles to footwear.

Conventional footwear design provides footwear with soles that allow a user's feet to stay warm, dry, and safe from injury. Often, though, when users are indoors, they prefer to wear slippers so as not to drag dirt into their homes or offices. Slippers, many of which have sturdy soles, are useful for when a user goes into a room with a cold tile floor, or even a child's playroom, where small toys and other stepping hazards are frequently strewn across the floor.

Many people prefer wearing socks alone to wearing slippers, especially when the socks are thick and comfy such as those made of fleece wool or fleece fabric, fur or fur lined fabric, sherpa fabric lined suede, or sherpa fabric lined sueded material, or thick knits. However, when users need additional sole protection, they often reach for their slippers, but slippers are not a good choice to wear outdoors or in garages or unfinished basements, because afterwards, the slippers are then dirty and, in the case of an outdoor trip, sometimes wet. When users reach for shoes as sole protection, they often find that their shoes are too small to fit over those thick socks.

Various sock/sole combinations have been proposed in the art that teach releasably connecting soles using elements that are disposed in the upper surface of the sole, which may be uncomfortable for a user to walk on or stand in. US 20080005927 (Hung) teaches a sock/sole combination with a first connector on the bottom of the sock that attaches to a second connector on the upper surface of an interchangeable sole, the first connector having a thickness with a predetermined wear proof effect and the connector pairs being VELCRO™ fasteners (magic tape) or equivalent separable fasteners. US 20160242504 (Crowley) discloses a footwear assembly secured by magnetic elements onto which a user stands, with a detachable sole having a first set of magnetic elements on its upper surface, and a footwear item such as a sock having a second set of magnetic elements on its bottom surface, and featuring strategic placement of magnets of differing polarities to facilitate proper attachment and discourage incorrect attachment and a wedge-shaped projection from its heel that allows a user to urge or press on it with one foot to facilitate detachment.

It is desirable to have a simple, convenient, securely attachable sole for footwear in which the sole attaches and detaches hands-free so that a user can put on and take off without bending down, in which the assembly is comfortable for the user to wear, and a user may keep thick socks on while leaving indoors without getting the socks dirty or wet.

SUMMARY

A footwear assembly or assembly with a releasably attachable sole has a sock and a water resistant oversock that is arranged to cover the user's toes and heels. The sock has a sock sole, an upper edge, a heel (sometimes referred to as a "heel flap") between the sock upper edge and the sock sole, and a sock attachment site that is located on or near the sock heel. The oversock, which may be water resistant and may be sized to fit over the sock when the sock is worn on a foot of the user, may have an oversock sole, an oversock rear section sized to contain at least a portion of a user's heel, and a toe cap sized to contain the sock over the user's toes. The oversock sole may be formed at least in part of a material that is stretchable to impart stretchiness along a length of the oversock between the toe cap and the oversock rear section. The oversock may have a rear edge with a protrusion extending outwardly from the oversock sole and sized to allow a second foot of the user to step thereon and to stretch the oversock sole between the toe cap and the oversock rear section. The oversock sole may have an oversock attachment site that is located on the oversock rear section and that corresponds in location to the sock attachment site. A user may releasably attach the sole to the footwear by putting the sock on his or her first foot, putting the oversock on over the sock, and using the user's second foot to stretch the oversock along the length of the oversock sole to fit the user's first foot into the oversock. The sole is stretched by the user pressing his or her second foot down on the protrusion extending outward from the oversock sole at the oversock heel. The sock is releasably secured into the oversock with corresponding elements of an attachment fastener on the sock and the oversock, which are brought into releasable attachment at a sock attachment site and a corresponding oversock site.

The footwear may also have an attachment fastener with a first attachment element that is located on the sock at the sock attachment site and a second attachment element that is located on the oversock at the oversock attachment site. The second attachment element may be releasably attachable to the first attachment element when the oversock is worn over the sock on the foot of the user.

In one embodiment, the oversock attachment site may touch the sock attachment site when the oversock is worn over the sock on the foot of the user.

In other embodiments, the oversock attachment site is magnetically attachable to the sock attachment site when the oversock is worn over the sock on the user's foot. In a further embodiment, the attachment fastener may have a set of magnetically attractable elements, the first attachment element being a first magnetically attractable element attachable to the sock at the sock attachment site, and the second attachment element being a second magnetically attractable element attachable to the oversock at the oversock attachment site. In still further embodiments, the first attachment element is located within the sock at the sock attachment site. The sock attachment site may have an interior layer and an exterior layer, and the first attachment element may be located between the interior layer and the exterior layer.

In further embodiments the oversock extends upward from the oversock sole to contain a portion of sides of a midfoot of a user. In still further embodiments, the oversock has an instep arch on a foot-facing surface of a sole of the oversock, and a patterned surface on a ground-facing surface of a sole of the oversock, and the oversock lacks an instep cover so that an instep of the user's foot is not enclosed at least in part.

In other embodiments, a water resistant oversock is sized to fit over a sock when the sock is worn on a foot of the user. The oversock may have an oversock sole, a rear section sized to contain at least a portion of a user's heel, a toe cap sized to contain the sock over a user's toes, and a protrusion extending outwardly from the sole. The oversock also may have an oversock attachment site that is located on the oversock rear section and that corresponds in location to a sock attachment site that is located on a heel of the sock. The oversock may also have an oversock attachment element that is located on the oversock attachment site and is releasably attachable to a sock attachment element on the sock at the sock attachment site when the oversock is worn over the sock on the foot of the user.

On other embodiments, a sock that is sized to fit under a water resistant oversock when the sock and oversock are worn on a foot of the user, may have a sock sole, an upper edge, a heel between the sock upper edge and the sock sole, and a sock attachment site that is located on the sock heel and that corresponds in location to a oversock attachment site on the oversock that is located on a rear section of the oversock. The sock may also have a sock attachment element that is located on the sock attachment site and is releasably attachable to an oversock attachment element on the oversock at the oversock attachment site when the sock is worn under the oversock on the foot of the user.

In other embodiments, a method is disclosed in which a sock is put onto a first foot of a user, with the sock covering the toes of the user; a water resistant, stretchable oversock having an oversock toe cap is put onto the first foot over the sock to cover at least a portion of the toes of the user; and the oversock is stretched along the length of a sole of the oversock with a second foot of the user to fit the first foot into the oversock; and bringing corresponding elements of an attachment fastener into releasable attachment, with a first element of the corresponding elements located on a sock attachment site on or near a heel of the sock and with a second element of the corresponding elements located on an oversock attachment site that corresponds in location to the sock attachment site when the oversock is worn over the sock of the first foot of the user.

In further embodiments, the corresponding elements of an attachment fastener may be a first magnetically attractable element attached to the sock attachment site, and a second magnetically attractable element attached to the oversock attachment site. The corresponding elements of the attachment fastener may be brought into releasable attachment by bringing the first magnetically attractable element into alignment with the second magnetically attractable element when the oversock is put on over the sock on the first foot.

In still further embodiments, the oversock is stretched with the second foot by placing the first foot bearing the oversock onto a surface; with the second foot, stepping onto a tab extending outwardly from the oversock sole on a rear edge of the oversock sole; and with the second foot, pressing the protrusion against the surface while sliding the first foot the first foot forward and away from the second foot and into the oversock toe cap.

The disclosed footwear assembly and method for releasably attaching a sole to the footwear is very adaptable and may be used to simply, conveniently, and securely attach a sole to a sock and detach it hands-free without bending down. Further, the sock/oversock footwear assembly is comfortable for the user to wear, and allows a user to keep thick socks on, clean, and dry during a quick trip outdoors or to a location where the floor may dirty or wet.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate one (several) embodiment(s) of the invention and together with the description, serve to explain the principles of the invention.

DETAILED DESCRIPTION

Figure 1A:
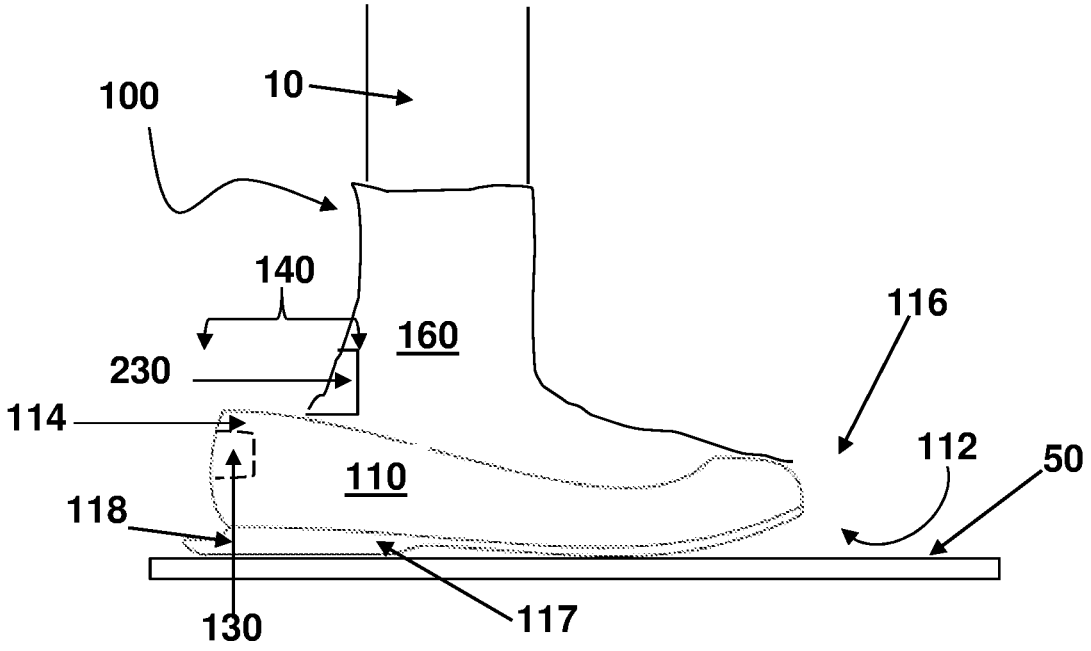
FIG. 1A is a side view of an exemplary footwear assembly 100 having an oversock 110 and a sock 160.

Reference will now be made in detail to the present exemplary embodiments, examples of which are illustrated in the accompanying drawings. Wherever possible, the same reference numbers will be used throughout the drawings to refer to the same or like parts.

A footwear assembly 100 (also known as a footwear assembly 100 or footwear 100) according to the present invention will now be described in detail with reference to FIGS. 1A to 1E and 2A to 2C of the accompanying drawings. The footwear assembly 100 may be used to temporarily and releasably apply a sole to the footwear. The footwear assembly 100 has an oversock 110 and a sock 160. The sock 160, which is sized to fit over a foot of a user, may be formed of any material that is appropriate for use in a sock—stretchy enough to fit over a foot and fitted or compressible enough to stay on the foot (suitable materials include but are not limited to fabrics such as fleece wool or fleece fabric, fur or fur lined fabric, sherpa fabric lined suede, or sherpa fabric lined sueded material, or thick knits). The sock may be thick and comfy, and come in colors and/or designs. The oversock 110, which is formed of a water resistant material, has a sole 112, a toe cap 116, and a rear section 114, such as a sole quarter, to cover at least a portion of the rear of the heel of the user's foot (the heel being the prominence at the posterior end of the foot, based on the projection of the heel bone behind the articulation of the bones of the lower leg). The material from which the oversock 110 is stretchable along the length of the oversock sole, and the oversock 110 is sized to fit over the sock 160 and to enclose at least the sock covering the user's toes and a portion of the rear of the user's foot when the oversock 110 is stretched along the length of the oversock sole 112. The oversock 110 thus may cover the front and back of the user's foot without completely enclosing an instep of the user's foot.

In some embodiments, such as that shown in FIGS. 1A-1E, the oversock 110 also has a heel 117 to raise the rear of the shoe in relation to the front, and it has a protrusion 118 extending outwardly from the heel 117 essentially planar to the surface 50 (such as the floor or ground) upon which the footwear user is standing or walking or is intending to do so. In the embodiment shown in FIG. 1A, the oversock 110 extends upward from the oversock sole 112 to contain a portion of sides of the user's foot.

Figure 1B:
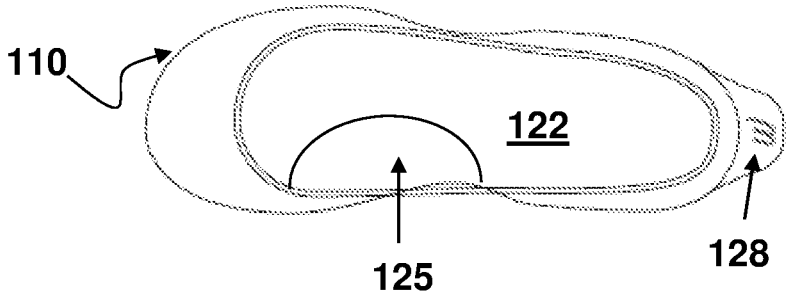
FIG. 1B is a top view of the oversock 110 of FIG. 1A, as removed from the sock 160.
Figure 1C:
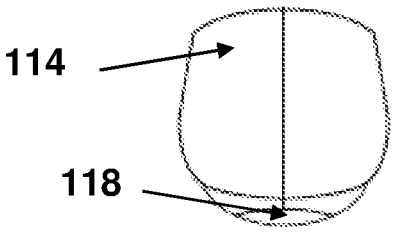
FIG. 1C is a rear view of the oversock 110 of FIG. 1B.
Figure 1D:
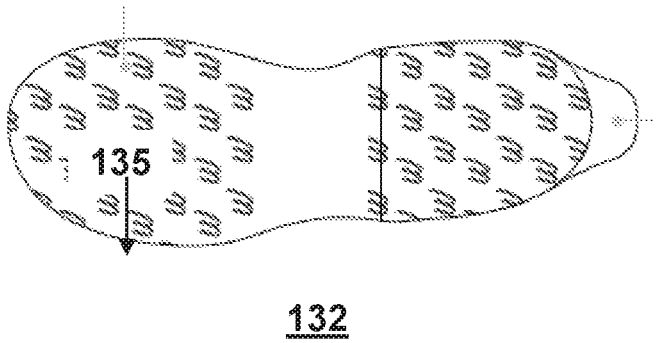
FIG. 1D is a bottom view of the oversock 110 of FIG. 1B.

As shown in FIG. 1B, the oversock 110 may have an instep arch 125 on a foot-facing surface 122 of a sole 112 of the oversock 110. As shown in FIG. 1D, the oversock 110 may have a patterned surface 135 on a ground-facing surface 132 of a sole 112 of the oversock 110 to provide traction to the oversock when pressed against the surface 50. As shown in FIG. 1A, the oversock 110 may lack an instep cover so that, while the oversock covers the sock, the oversock does not completely enclose an instep of the user's foot at least in part.

As also shown in FIG. 1A, the protrusion 118 on the rear of the oversock sole may be a tab 128 extending outwardly from the oversock 110 to form a step platform for a second foot of the user to step on when the oversock 110 is worn over the sock 160 on the user's foot.

Figure 1E:
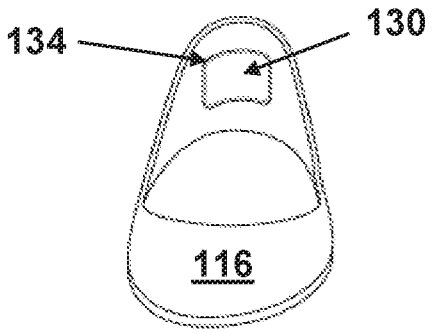
FIG. 1E is a front perspective view of the oversock 110 of FIG. 1B.
Figure 1F:
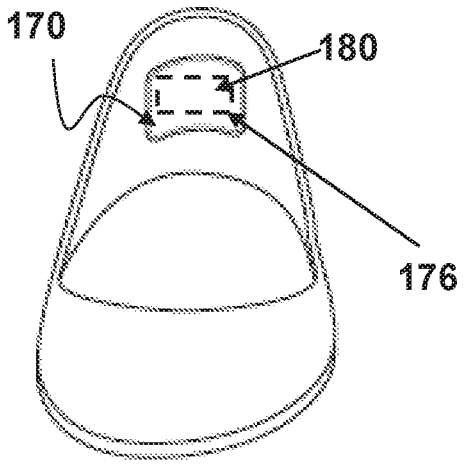
FIG. 1F is a rear view of an alternative embodiment of an oversock 170 with an alternative fastener component.
Figure 1G:
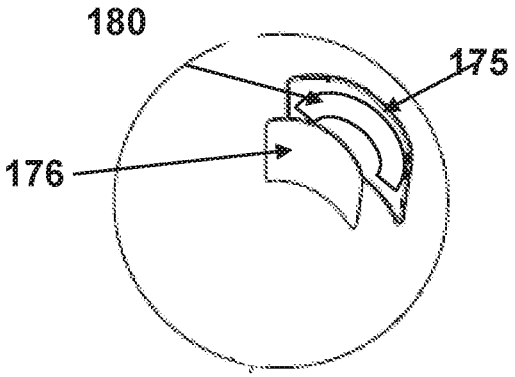
FIG. 1G is a detail, exploded view of an exemplary alternative fastener component with an alternative fastener component; shown on an exemplary oversock 170.
Figure 2A:
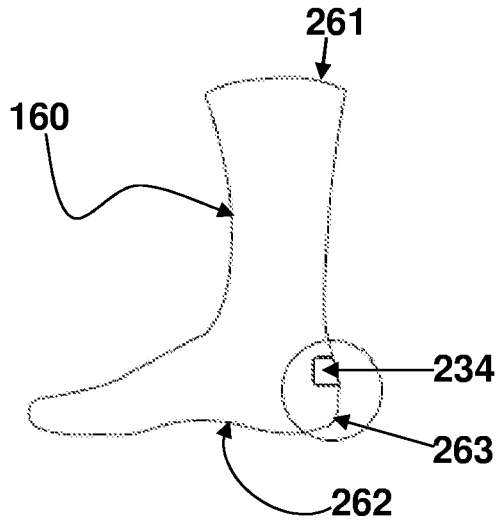
FIG. 2A is a side view of the sock 160 of FIG. 1A with the oversock 110 removed therefrom.
Figure 2B:
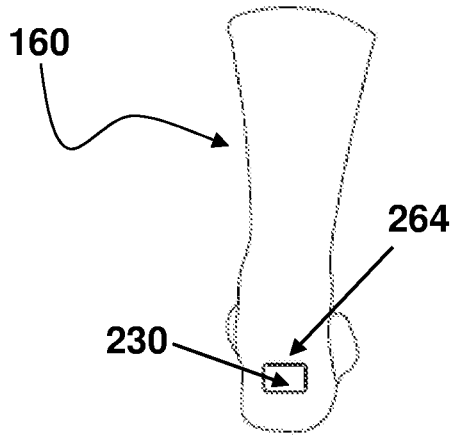
FIG. 2B is a rear view of the sock 160 of FIG. 2A.
Figure 5A:
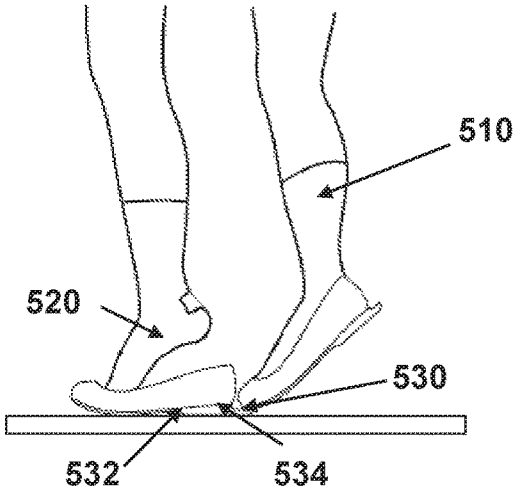
FIG. 5A is a side view of the oversock 110 being attached to the sock 160, illustrating stages of a method for attaching the oversock 110 to the sock 160.
Figure 5B:
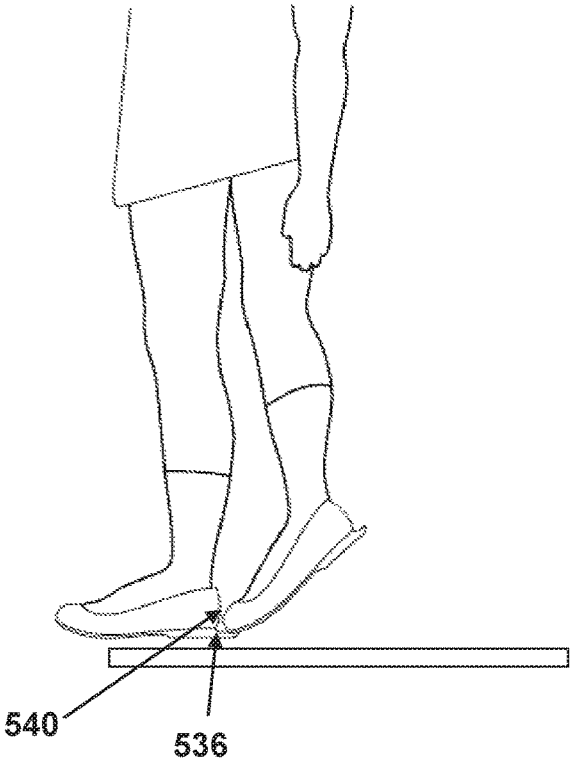
FIG. 5B is a side view of the oversock 110 being attached to the sock 160, illustrating other stages of the method for attaching the oversock 110 to the sock 160.
Figure 5C:
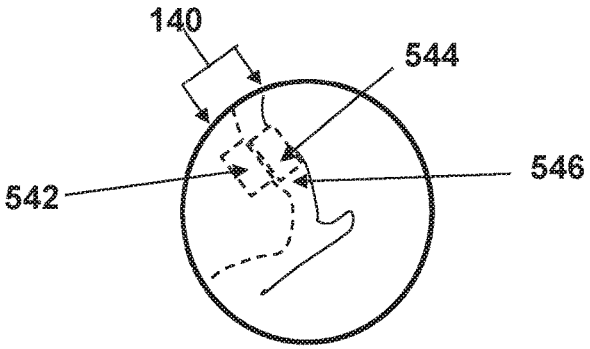
FIG. 5C is a detail, exploded view of the exemplary attachment fastener 140, illustrating stages of the method for attaching its components.

As shown in FIGS. 1A-1G and 2A-2C, the sock 160 and the oversock 110 also may have corresponding elements of an attachment fastener 140, which is also shown in FIG. 5C in an illustration of stages of a method for attaching an oversock to a sock. The attachment fastener 140 may have a first attachment element 230 that is shown in FIGS. 1A, 2B as being located on the sock 160 at a sock attachment site 234 on the heel 264. The attachment fastener 140 may also have a second attachment element 130 that is shown in broken lines in FIG. 1A and also shown in FIG. 1E as being located on the oversock 110 at an oversock attachment site 134 on the interior (foot-facing surface) of the rear section 114 of the oversock, with the oversock attachment site 134 corresponding in location to the sock attachment site 234. The attachment fastener elements 130, 230 are releasably attachable to each other when the oversock 110 is worn over the sock 160 on the foot of the user. As shown in FIG. 1E, although it is not essential to the design of the oversock shown in FIG. 1A, an oversock 170 may have an interior layer 175 and an exterior layer 176 formed of any suitable material, such as cloth, plastic, foam, leather, or rubber; and the oversock 170 may have a first attachment element 180 located between the interior layer 175 and the exterior layer 176.

In the embodiment shown in FIGS. 1A to 1E and 2A to 2C, the sock has a sock sole 262, an upper edge 261, and a heel 264 between the sock upper edge 261 and the sock sole 262. The heel 254 may also have a heel turn 263 near the sock sole 262, the heel turn providing an L-shaped bend in the sock, and a rear portion 267 between the heel turn 263 and the upper edge 261 on the rear of the sock 160. The sock attachment site 234 is located at or near the heel rear portion 267. In addition, the oversock attachment site 134, which, as noted above, is disposed on the interior (foot-facing surface) of the rear section 114 of the oversock, touches the sock attachment site 234 when the oversock 110 is worn over the sock 160 on the foot of the user. Further, the oversock attachment site 134 may be magnetically attachable to the sock attachment site 234 when the oversock 110 is worn over the sock 160 on the user's foot. The attachment fastener 140 may be a set with two magnetically attractable elements, with the first attachment element 230 shown in FIG. 2C being a first magnetically attractable element attachable to the sock 160 at the sock attachment site 234, and the second attachment element 130, which is shown in FIGS. 1E-1G being a second magnetically attractable element attachable to the oversock 110 at the oversock attachment site 134.

Figure 2C:
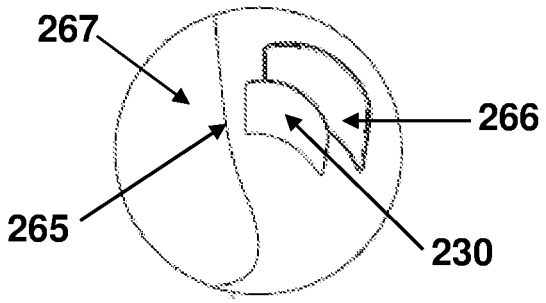
FIG. 2C is a detail, exploded view of the exemplary fastener component shown on the sock 160 of FIG. 2A.

In the embodiment shown in FIGS. 2A and 2B, and in greater detail and exploded view in FIG. 2C, the first attachment element 230 may be located within the sock 160 at the sock attachment site 234. As shown in FIGS. 2A and 2B, although it is not essential to the design of the sock shown in FIGS. 2A and 2B, the sock attachment site 234 is shown with an interior layer 265 and an exterior layer 266, with the first attachment element 230 located between the interior layer 265 and the exterior layer 266.

Figure 3A:
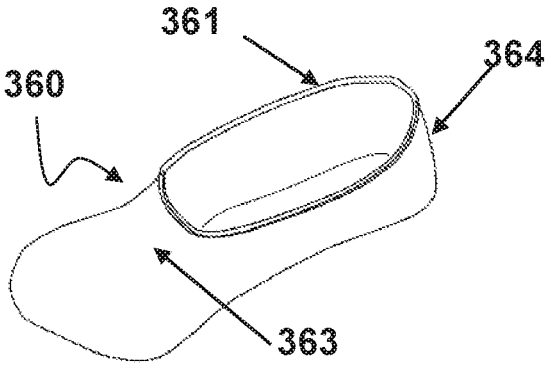
FIG. 3A is a perspective view of an alternative exemplary embodiment of a sock 360.
Figure 3B:
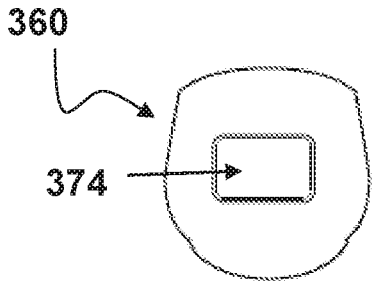
FIG. 3B is a rear view of the sock 360 of FIG. 3A.
Figure 3C:
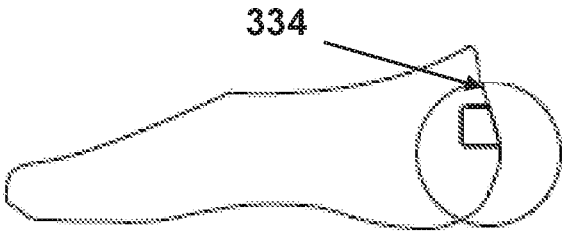
FIG. 3C is a side view of the sock 360 of FIG. 3A.
Figure 3D:
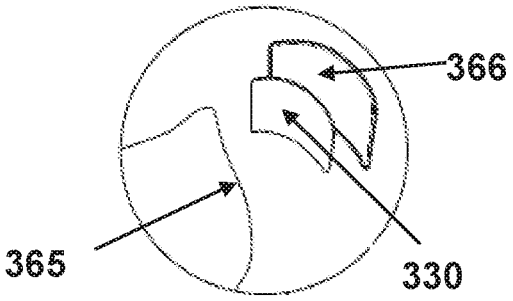
FIG. 3D is a detail, exploded view of the exemplary fastener component shown on the sock 360 of FIG. 3C.

One of skill in the art will appreciate that the above-described designs may be embodied in several ways. For example, as shown in FIGS. 3A-3B, while the sock 160 shown in FIG. 2A-2C has a tall leg, an alternative sock 360 for use in an alternative footwear assembly or for use with oversock 110, may have an upper edge 361 at the upper edge of the instep 363 and heel 364. In other embodiments, at the election of the designer, the sock may have a short leg (not shown). In the alternative sock 360, the first attachment element 330 may be located within the sock 360 at the sock attachment site 334. As with the embodiment shown in FIGS. 2A and 2B, the first attachment element 330 may be located within the sock 360 at the sock attachment site 334. At the designer's election, as shown in FIGS. 3C and 3D, the sock attachment site 334 may have an interior layer 365 and an exterior layer 366, and the first attachment element 330 may be located between the interior layer 365 and the exterior layer 366.

Figure 4A:
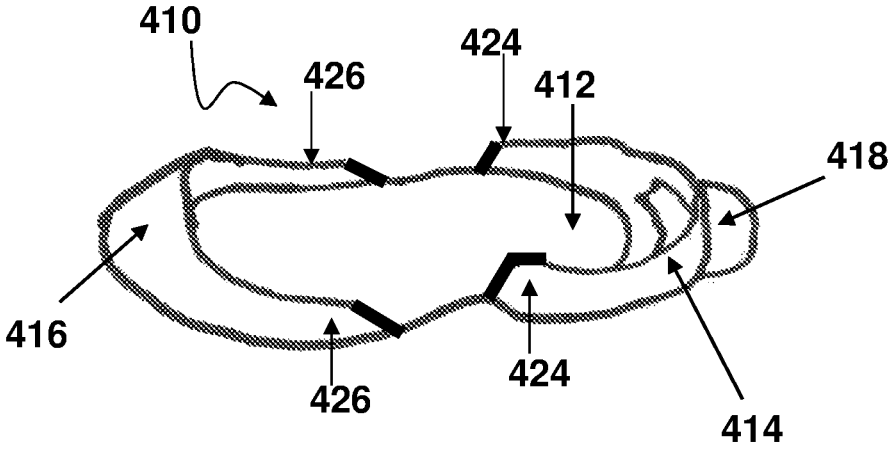
FIG. 4A is a perspective side view of an alternative exemplary embodiment of an oversock 410.
Figure 4B:
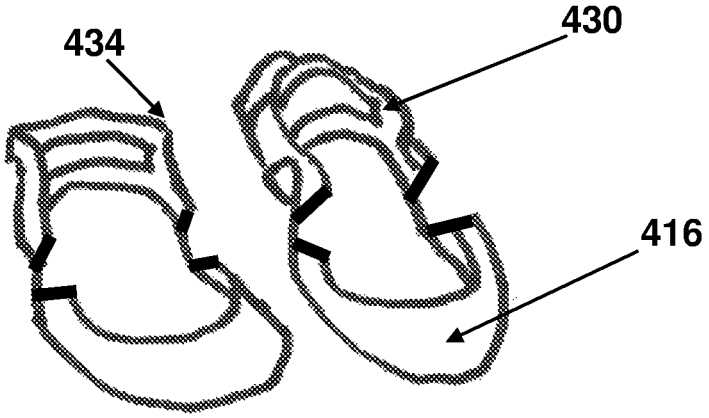
FIG. 4B is a perspective front view of the oversock 410 of FIG. 4A.

Further, as shown in FIGS. 4A-4B, while the oversock 110 shown in FIG. 2A-2C extends upward from the oversock sole 112 to contain a portion of sides of the user's foot, an alternative oversock 410 for use in an alternative footwear assembly or for use with a sock 160, may have a sole 412, a toe cap 416 with side panels 426, a protrusion 418, and a rear section 414 with side panels 424, an oversock attachment site 434, and a second attachment element 430, but it lacks any material extending upward from the sole 412 between the rear section 414 and the toe cap 416 so as to prevent an instep of the user's foot from being completely enclosed by the oversock 410, at least in part disconnecting the oversock rear section side panels 424 from toe cap side panels 426.

In use, with reference to the diagrams shown in FIGS. 5A and 5B, a user may releasably attach the sole to the footwear by putting the sock on his or her first foot (stage 510); putting a water resistant, stretchable oversock on over the sock and using the user's second foot to stretch the oversock along the length of the oversock sole to fit the user's first foot into the oversock (stage 530). The sole is stretched by the user pressing his or her second foot down on a protrusion extending outward from the oversock sole at the oversock heel. The sock is releasably secured into the oversock with corresponding elements of an attachment fastener on the sock and the oversock, which are brought into releasable attachment at a sock attachment site and a corresponding oversock site (stage 540). In certain methods of use, the oversock as put on over the sock covers the user's toes and heels without completely enclosing an instep of the first foot (stage 520).

The oversock may be stretched with the second foot by placing the first foot bearing the oversock onto a surface (stage 532); with the second foot, stepping onto a tab extending outwardly from the oversock sole on a rear edge of the oversock sole (stage 534); and, with the second foot, pressing the tab against the surface while pushing the first foot into the oversock toward a toe of the oversock and away from the tab (stage 536). Thus, the sole may be slipped onto the sock-wearing foot without the user bending down; the sole quarter and sock heel, forced into contact with each other, connect with a magnetizing force holding them together.

As shown in FIG. 5C, when the foot is inserted into the sole, the magnetic element in the rear section of the oversock is superimposed over the magnetic element in the heel of the sock. Corresponding elements of an attachment fastener 140 may be brought into releasable attachment by attaching a first attachment element of the attachment fastener to the sock attachment site (stage 542); attaching a second attachment element of the attachment fastener to the oversock attachment site (stage 544), and bringing the first attachment element into alignment with the second attachment element when the oversock is put on over the sock on the first foot (stage 546). In another embodiment, the corresponding elements of an attachment fastener are a first attachment element of the attachment fastener attached to the sock attachment site and a second attachment element of the attachment fastener attached to the oversock attachment site; and the corresponding elements of an attachment fastener are brought into releasable attachment by bringing the first attachment element into alignment with the second attachment element when the oversock is put on over the sock on the first foot (stage 546).

Figure 5D:
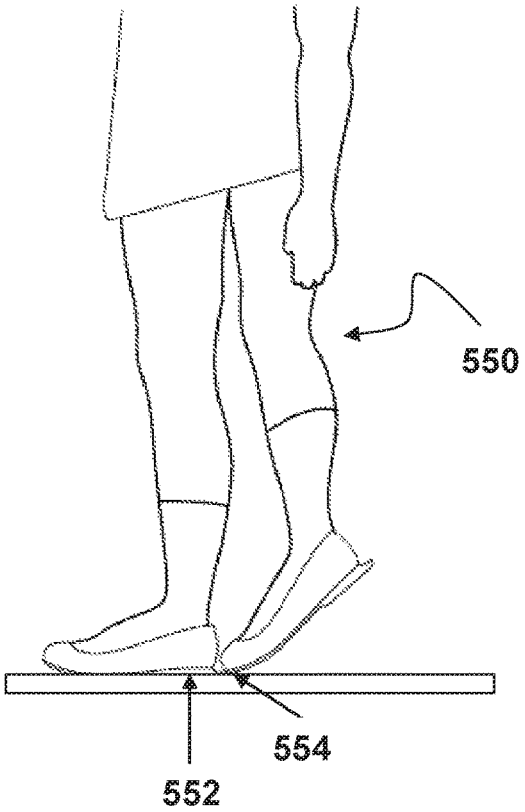
FIG. 5D is a side view of the oversock 110 being detached from the sock 160, illustrating stages of a method for detaching the oversock 110 from the sock 160.
Figure 5E:
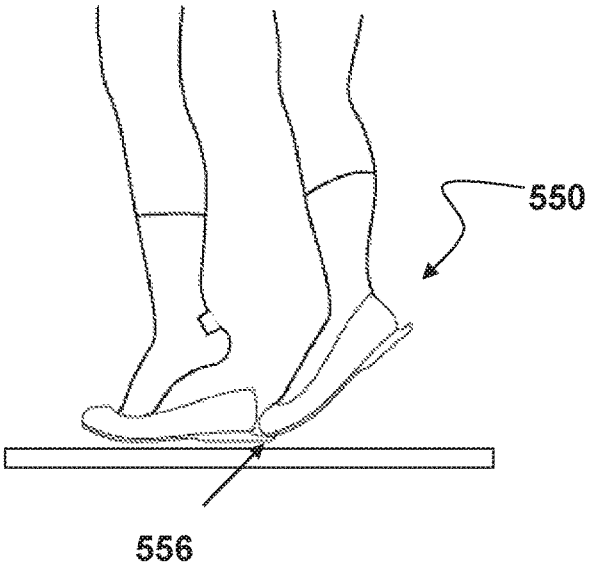
FIG. 5E is a side view of the oversock 110 being detached from the sock 160, illustrating other stages of the method for detaching the oversock 110 from the sock 160.

As shown in FIGS. 5D and 5E, the sock attachment site may be releasably detached from the oversock attachment site (stage 550) by placing the first foot bearing the oversock onto a surface (stage 552); with the second foot, stepping onto a tab extending outwardly from the oversock sole on a rear edge of the oversock sole between the second foot and the surface (stage 554); and with the second foot, pressing the tab against the surface while sliding the first foot back toward the tab, up from the tab, and out of the oversock (stage 556). With the user holding the sole on the surface with the opposite foot while stepping up and out of the sole portion, a lateral shearing force is created that overcomes the magnetic force holding the sole and sock magnetic elements together, allowing the sock to separate from the sole.

It may be seen that the embodiments of the footwear assemblies and related methods for attaching a sole to footwear disclosed here may be used to greatly simplify convenient, secure releasable attachments of soles to footwear. Many features are described that may be included in footwear assemblies to make footwear with removable soles comfortable for the user to wear, and help a user to keep thick socks on while leaving indoors without getting socks dirty or wet. In addition, the disclosed systems and methods reduce environmental stress because a sock or oversock may last longer than the other, and the worn out component may be replaced so that the footwear assembly may remain usable. Further, a user may obtain several pairs of socks for the footwear assembly for replacement use in the footwear assembly when the original pair of socks become dirty or otherwise unwearable, or when the user desires a change of socks for any other reason.

In addition, although the disclosed components have been described above as being separate units, one of ordinary skill in the art will recognize that functionalities provided by one or more units may be combined. As one of ordinary skill in the art will appreciate, one or more units may be optional and may be omitted from implementations in certain embodiments.

The foregoing descriptions have been presented for purposes of illustration. It is not exhaustive and does not limit the invention to the precise forms or embodiments disclosed. Modifications and adaptations of the invention will be apparent to those skilled in the art from consideration of the specification and practice of the disclosed embodiments. For example, the described implementations may be implemented in a variety of materials, sizes and shapes, and be arranged differently than the figures illustrate. It is intended that the specification and examples be considered as exemplary only, with a true scope and spirit of the invention being indicated by the following claims.

The invention claimed is:

1. A footwear assembly comprising:

a sock sized and arranged to fit over a first foot of a user, wherein the sock has a sock sole, an upper edge, and a heel between the sock upper edge and the sock sole, wherein the heel has a heel turn disposed on the heel near the sock sole, the heel turn arranged to provide an L-shaped bend in the sock, and a heel rear portion disposed between the heel turn and the sock upper edge on a rear of the sock, and wherein the sock further has a single sock attachment site, wherein the sock is releasably attachable to an oversock at only the single sock attachment site, and wherein the single sock attachment site is located on or near the heel rear portion; and a water resistant oversock sized to fit over the sock when the sock is worn on the first foot of the user, and having:

a toe cap sized to contain the sock over the user's toes on the first foot;

an oversock rear section sized to contain at least a portion of a heel of the first foot of the user;

an oversock sole therebetween, the oversock sole:

formed at least in part of a stretchable material to impart an amount of stretchiness along a portion of the oversock between the toe cap and the oversock rear section, the amount of stretchiness selected to allow the portion of the oversock between the toe cap and the oversock rear section to increase in length an amount sufficient to allow the first foot of the user to slide out of engagement with the oversock when the sock is being worn on the first foot, and having a rear edge with a protrusion extending from and behind the oversock sole and sized to allow a second foot of the user to step thereon and to stretch the oversock sole between the toe cap and the oversock rear section, and a single oversock attachment site that is located on a rear section of the oversock and that corresponds in location to the single sock attachment site when the oversock is worn over the sock of the first foot of the user, wherein the oversock is releasably attachable to the sock at only the single oversock attachment site; and a set of magnetically attractable elements having:

a first attachment element that is magnetically attractable and is located on the sock at the single sock attachment site and a second attachment element that is magnetically attractable and is located on the oversock at the single oversock attachment site, an amount of attachability between the first attachment element and the second attachment element that is sufficiently high to bring the first attachment element and the second attachment element into releasable attachment when the first attachment element is in alignment with the second attachment element, and an amount of shear strength between the first attachment element and the second attachment element that is sufficiently low to allow a lateral shearing force applied to the aligned first attachment element and second attachment element to overcome attachment therebetween and effect detachment when the sock is worn under the oversock on the first foot, wherein the first attachment element is magnetically attachable to the second attachment element when the oversock is worn over the sock on the first foot of the user, and wherein the amount of attachability and the amount of shear strength is selected to allow hands-free attachment and detachment of the sock from the oversock while allowing the sock to remain on the first foot.

2. The footwear assembly of claim 1, wherein the single oversock attachment site touches the single sock attachment site when the oversock is worn over the sock on the first foot of the user.

3. A method, comprising:

putting a sock onto a first foot of a user, the sock covering toes of the user;

putting the sock into a toe cap of a water resistant, stretchable oversock, with the oversock toe cap covering at least a portion of the toes of the user;

conducting a hands-free attachment of the sock to the oversock while the sock is being worn on the first foot, with the hands-free attachment occurring on the sock at only a single sock attachment site, and on the oversock at only a single oversock attachment site, wherein the single sock attachment site is located on or near a heel rear portion of the sock, with the heel rear portion disposed on a rear of the sock between a heel turn and a sock upper edge, and with the heel turn disposed on a heel of the sock near a sock sole and arranged to provide an L-shaped bend in the sock, and wherein the single oversock attachment site is located on a rear section of the oversock and corresponds in location to the single sock attachment site on the sock, and with the hands-free attachment conducted by:

placing the first foot bearing the oversock onto a surface, stepping with a second foot of the user on a protrusion extending from and behind a rear edge of the sole, moving the first foot of the user forward and away from the second foot to stretch the oversock along the length of the oversock sole to fit the first foot into the oversock, bringing corresponding elements of an attachment fastener into releasable attachment, with the corresponding elements further comprising a set of magnetically attractable elements with:

a first attachment element that is magnetically attractable and is located on the sock at the single sock attachment site, and a second attachment element that is magnetically attractable and is located on the oversock at the single oversock attachment site, wherein bringing the corresponding elements of the attachment fastener into releasable attachment further comprises aligning the first attachment element with the second attachment element; and conducting a hands-free detachment of the sock from the oversock while the sock is being worn on the first foot, by:

stretching a portion of the oversock between the toe cap and the oversock rear section to increase the oversock in length, applying a lateral shearing force to the attached first attachment element and second attachment element to overcome attachment therebetween and to effect detachment therefrom, and sliding the sock out of engagement with the oversock.

4. The method of claim 3, wherein conducting the hands-free detachment of the sock from the oversock further comprises releasably detaching the first attachment element from the second attachment element by:

placing the first foot bearing the oversock onto a surface;

with the second foot, stepping onto the protrusion; and with the second foot, pressing the protrusion against the surface while sliding the first foot forward and away from the second foot, up from the protrusion, and out of the oversock.

5. An oversock sized to fit over a sock when the sock is worn on a first foot of a user, wherein the oversock comprises:

an oversock rear section sized to contain at least a portion of a heel of the first foot of the user;

a toe cap sized to contain the sock over the user's toes on the first foot;

an oversock sole therebetween, the oversock sole formed at least in part of a water resistant, stretchy material to impart an amount of water resistant stretchiness along a length of the oversock between the toe cap and the oversock rear section, the amount of water-resistant stretchiness selected to allow the portion of the oversock between the toe cap and the oversock rear section to increase in length an amount sufficient to allow the first foot of the user to slide out of engagement with the oversock when the sock is being worn on the first foot, and having a rear edge with a protrusion extending from and behind from the oversock sole and sized to allow a second foot of the user to step thereon and to stretch the oversock sole between the toe cap and the oversock rear section;

a single oversock attachment site, wherein the oversock is releasably attachable to the sock at only the single oversock attachment site, and wherein the single oversock attachment site is located on a rear section of the oversock and corresponds in location on the oversock to a single sock attachment site on the sock, with the sock releasably attachable to the oversock at only the single sock attachment site, with the single sock attachment site located at or near a heel rear portion of the sock, the heel rear portion of the sock being disposed between a heel turn and a sock upper edge on a rear of the sock; and an oversock attachment element that is magnetically attractable and is located on the single oversock attachment site and is releasably attachable hands-free to a sock attachment element that is magnetically attractable and is located on the sock at the single sock attachment site when the sock is worn under the oversock on the foot of the user, wherein the oversock attachment element has, with the sock attachment element, an amount of attachability that is sufficiently high to bring the oversock attachment element into releasable attachment with the sock attachment element when the oversock attachment element is in alignment with the sock attachment element, and an amount of shear strength that is sufficiently low to allow a lateral shearing force applied to the aligned sock attachment element and oversock attachment element to overcome attachment therebetween when the oversock is worn over the sock on the first foot, the amount of attachability and the amount of shear strength allowing hands-free attachment and detachment of the oversock from the sock while allowing the sock to remain on the first foot.

6. The oversock of claim 5, further comprising an oversock instep arch on a foot-facing surface of the oversock sole.

7. The oversock of claim 5, further comprising a patterned surface on a ground-facing surface of the oversock sole.

8. The oversock of claim 5, wherein the oversock extends upward from the oversock sole to contain at least a portion of sides of a midfoot of the user.

9. The oversock of claim 5, wherein the oversock attachment element is magnetically attachable to the sock attachment element when the oversock is worn over the sock on the user's foot.

10. The oversock of claim 5, wherein the oversock rear section has side panels that are at least in part disconnected from side panels of the toe cap.

11. The oversock of claim 5, wherein the protrusion further comprises a tab on the rear edge of the oversock sole, and wherein the tab extends outwardly from the oversock to form a step platform for the second foot of the user.

* * * * *